US009157644B2

(12) United States Patent
Hou

(10) Patent No.: US 9,157,644 B2
(45) Date of Patent: Oct. 13, 2015

(54) AIR HUMIDIFIER

(71) Applicant: Jack Hou, Sterling, VA (US)

(72) Inventor: Jack Hou, Sterling, VA (US)

(73) Assignee: Giftec, LTD, Sterling, VA (US)

( * ) Notice: Subject to any disclaimer, the term of this patent is extended or adjusted under 35 U.S.C. 154(b) by 196 days.

(21) Appl. No.: 13/986,410

(22) Filed: Apr. 30, 2013

(65) Prior Publication Data

US 2013/0300005 A1 Nov. 14, 2013

Related U.S. Application Data

(63) Continuation-in-part of application No. 12/078,815, filed on Apr. 7, 2008, now Pat. No. 8,025,270.

(30) Foreign Application Priority Data

May 4, 2012 (CH) ..... 10136112/12

(51) Int. Cl.
*B01F 3/04* (2006.01)
*F24F 6/02* (2006.01)
*F24F 6/12* (2006.01)

(52) U.S. Cl.
CPC ..... *F24F 6/02* (2013.01); *B01F 3/0407* (2013.01); *B01F 3/04021* (2013.01); *F24F 6/12* (2013.01); *Y10S 261/65* (2013.01)

(58) Field of Classification Search
CPC ..... B01F 3/04; B01F 3/0407; B01F 3/04007; B01F 3/04021
USPC ..... 261/81, 78.2, 119.1, DIG. 65
See application file for complete search history.

(56) References Cited

U.S. PATENT DOCUMENTS 3,817,499 A * 6/1974 Lerou ..... 261/29

FOREIGN PATENT DOCUMENTS

JP 54101507 A * 8/1979 ..... 239/102.2

* cited by examiner

*Primary Examiner* — Robert A Hopkins

(57) ABSTRACT

An air humidifier comprises a base. An opening water tank is integrated into the humidifier base. A water inlet is opening on the upper surface of the casing. The inside of the base is combined with the water tank and an atomizing chamber. The atomizing chamber is composed of a water sub-tank, a water level control board and the bottom of the water tank form a first chamber, A water opening is provided at the bottom of the water tank. A water level control board is provided with a water exit valve corresponding to the water opening. The water exit valve is provided for controlling the flow rate and on/off of the water flow downwardly from the water tank through the water sub-tank. On the water sub-tank is provided with the atomization device and an automatic breaker. The atomization device can be an ultrasonic device or a heater or filter for transforming water into vapor. A fan is installed on the base. A first vapor opening is disposed on the upper surface of the casing.

14 Claims, 16 Drawing Sheets

AIR HUMIDIFIER

RELATED APPLICATION

The present application is a continuation in part (CIP) of U.S. application Ser. No. 12/232,396 (incorporated herein by reference, issued as U.S. Pat. No. 8,232,396 on Feb. 12, 2013), and U.S. application Ser. No. 12/232,396 is a CIP of U.S. application Ser. No. 12/078,815 (incorporated herein by reference, issued as U.S. Pat. No. 8,025,270 on Sep. 27, 2011).

FIELD OF THE INVENTION

This invention relates to a humidifier, in particular to a humidifier that can provide a easy to refilled the water (no need to take out water tank), and function of decoration.

BACKGROUND OF THE INVENTION

The conventional humidifiers mostly serve the purpose of humidifying the air or the rooms, and are rarely being decorative.

Various examples of conventional humidifiers or decorative structures are listed in the information disclosure statement.

SUMMARY OF THE INVENTION

The present invention relates to a humidifier that can easy to filled the water and provide a function of decoration, and filtering.

Furthermore, the humidifier of the present invention can provide not only vapor, but also anion to the air or the rooms, and various embodiments of decorations, most of them involve some subassembly or moving mechanisms, can be used in this invention.

The decorative humidifier of the present invention can make anion also be served as an air cleaner.

DETAILED DESCRIPTION OF THE INVENTION

Figure 1:
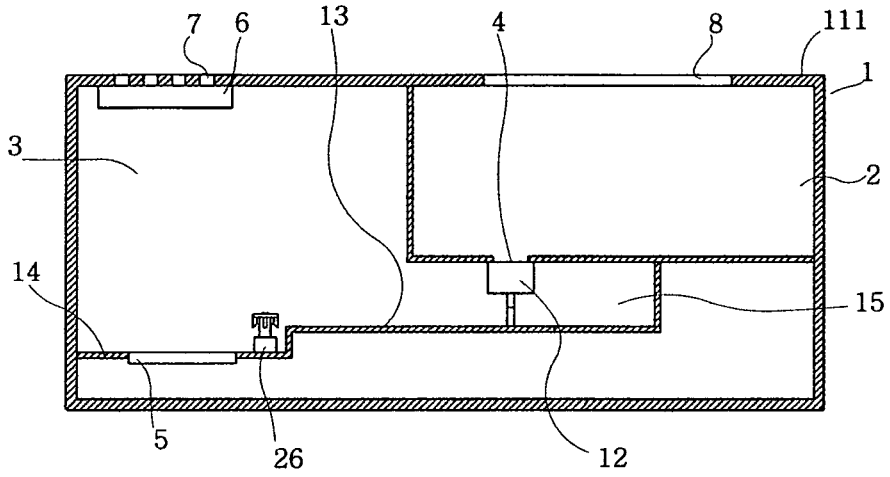
FIG. 1 illustrates an exploded view of the first embodiment of the present invention.

As shown in FIG. 1, an air humidifier comprises a base 1. An opening water tank 2 is integrated into the humidifier base 1. A water inlet 8 is opening on the upper surface of the casing 111. The inside of the base 1 is combined with the water tank 2 and an atomizing chamber 3. The atomizing chamber 3 is composed of a water sub-tank 14. The water tank 2 with the atomizing chamber 3 and sub-water tank 14 are provided with the base 1. A water level control board 13 and the bottom of the water tank 2 form a first chamber 15. A water opening 4 is provided at the bottom of the water tank 2. A water level control board 13 is provided with a water exit valve 12 corresponding to the water opening 4. The water exit valve 12 is provided for controlling the flow rate and on/off of the water flow downwardly from the water tank 2 through the water sub-tank 14. On the water sub-tank 14 is provided with the atomization device 5 and an automatic breaker 26. The atomization device 5 can be an ultrasonic device or a heater or filter for transforming water into vapor. A fan 6 is installed on the base 1. A first vapor opening 7 is provided on the upper surface of the casing 111.

Figure 2:
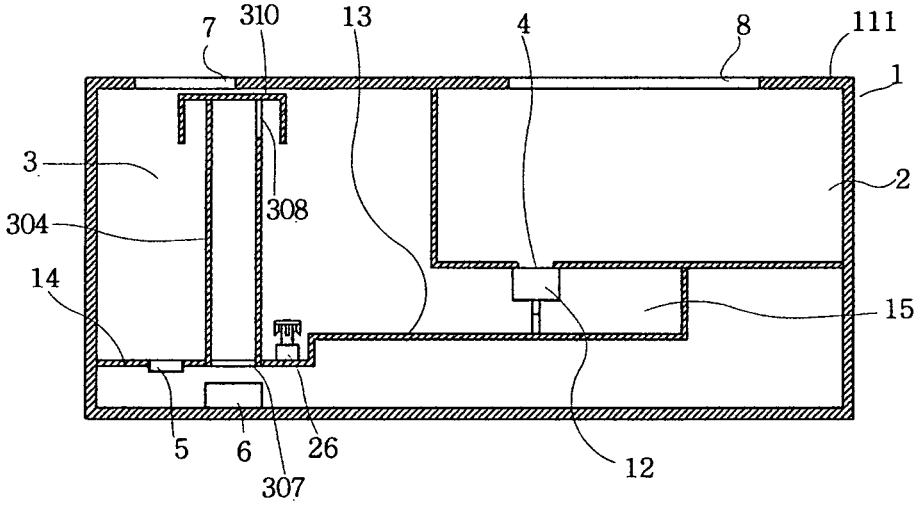
FIG. 2 illustrates an exploded view of the second embodiment of the present invention.

FIG. 2 shown an air guide 304 with an air opening 308 and an air inlet 307 is provided on the water sub-tank 14. When the humidifier is turned on, the opening water tank 2 is filled with water, the water can flow through the water opening 4 into the water sub-tank 14. The atomization device 5 generates vapor with an ultrasonic device or a heater. The fan 6 on the bottom of the base 1, sucks air from the space under the fan 6 upwardly, forces the air to go through the first air guide tube 304 from air inlet 307, toward the air opening 308 to exit through the first vapor opening 7. The first air guide tube 304 is connected with water sub-tank 14. A protect cover 310 cover the air opening 308 to avoid the water flow into the air opening 308 when the ultrasonic device generates the vapor.

Figure 3:
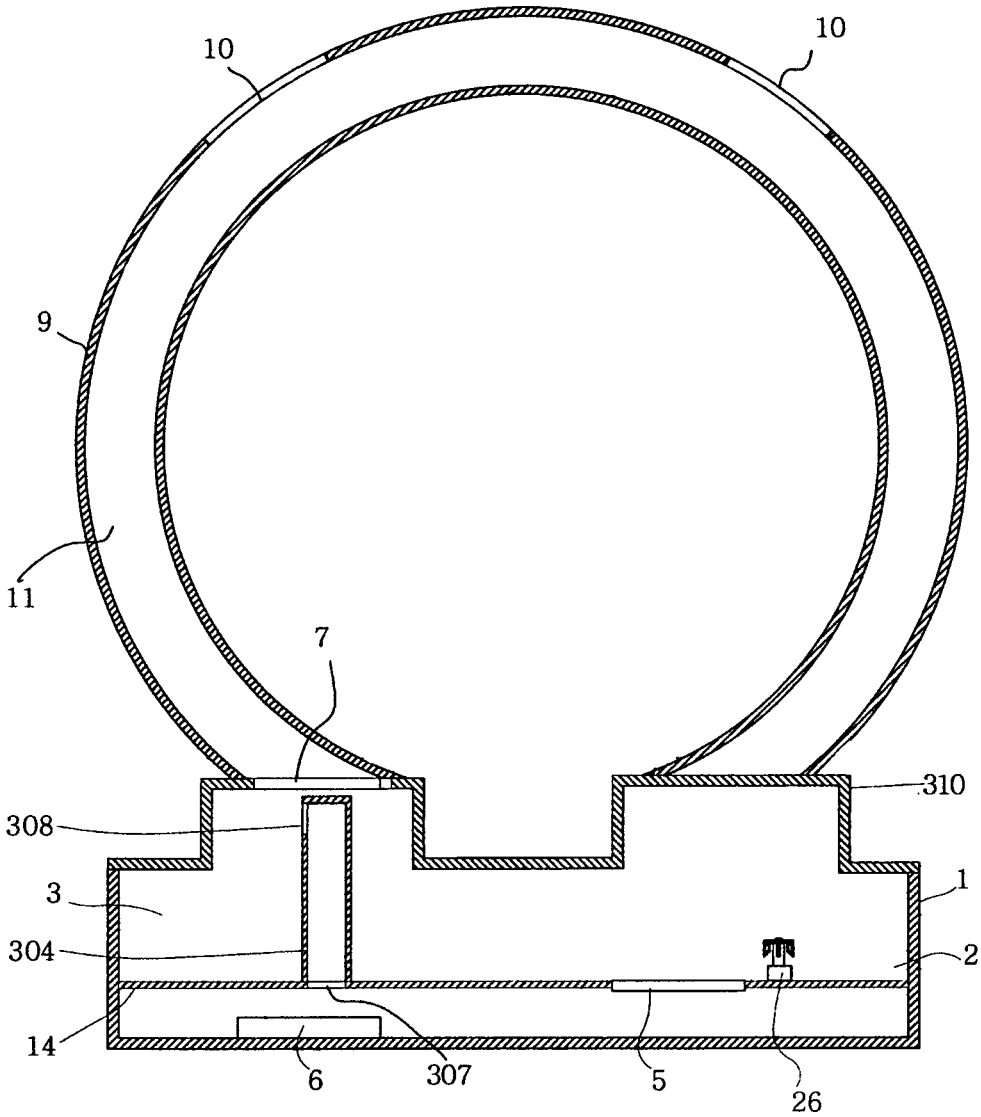
FIG. 3 illustrates an exploded view of the third embodiment of the present invention.

FIG. 3 shows the humidifier base 1 is disposed with a layer of a first ornament 9. The first ornament 9 is annular and connected in outside of the base 1. Inside the first ornament 9 is disposed with a second air guide tube 11, which is connected with the first vapor opening 7 and which is used for a second vapor opening 10 that is disposed on the first ornament 9. The fan 6 sucks air from the base 1 forces the air to go through the first air guide tube 304 from air inlet 307, toward the air opening 308 to exit through the first vapor opening 7 and go through the second air guide tube 11, toward the second vapor opening 10. The second air guide tube 11 should be longer than the height of the base 1, or the second vapor opening 10 should be higher than the first vapor opening 7 by at least half or same height of the casing 111 to keep enough vapor for best effect and make the whole design more valuable. The cover 310 can be combined with the first ornament 9, which includes the second air guide tube 11, the second vapor opening 10, and the first vapor opening 7, which are all shared in one component. It is easy to take out cover 310 to refill water or for cleaning. The water tank 2 is combined with water sub-tank 14 to form a single component. FIG. 1, FIG. 2 and FIG. 8 to FIG. 33 can be used in this embodiment.

Figure 4:
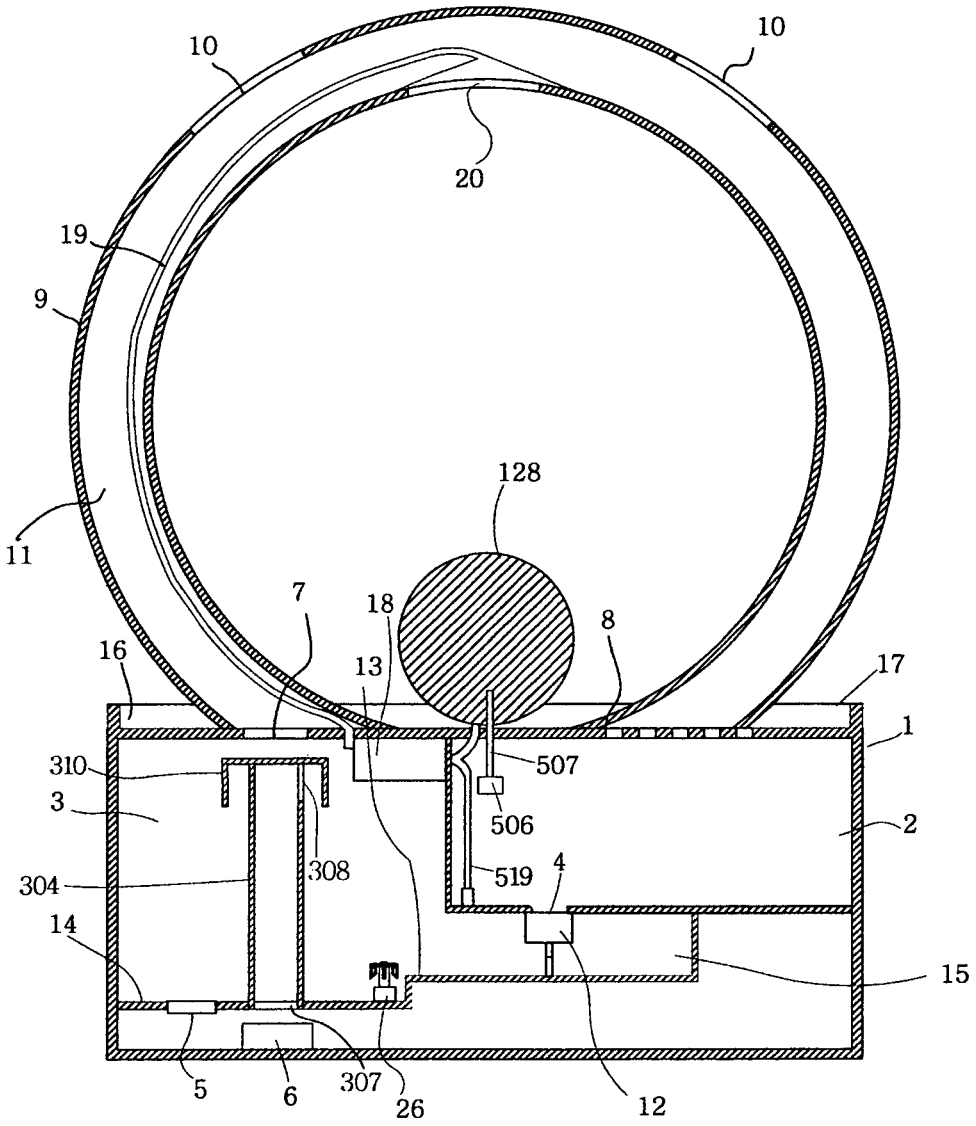
FIG. 4 illustrates an exploded view of the fourth embodiment of the present invention.
Figure 5:
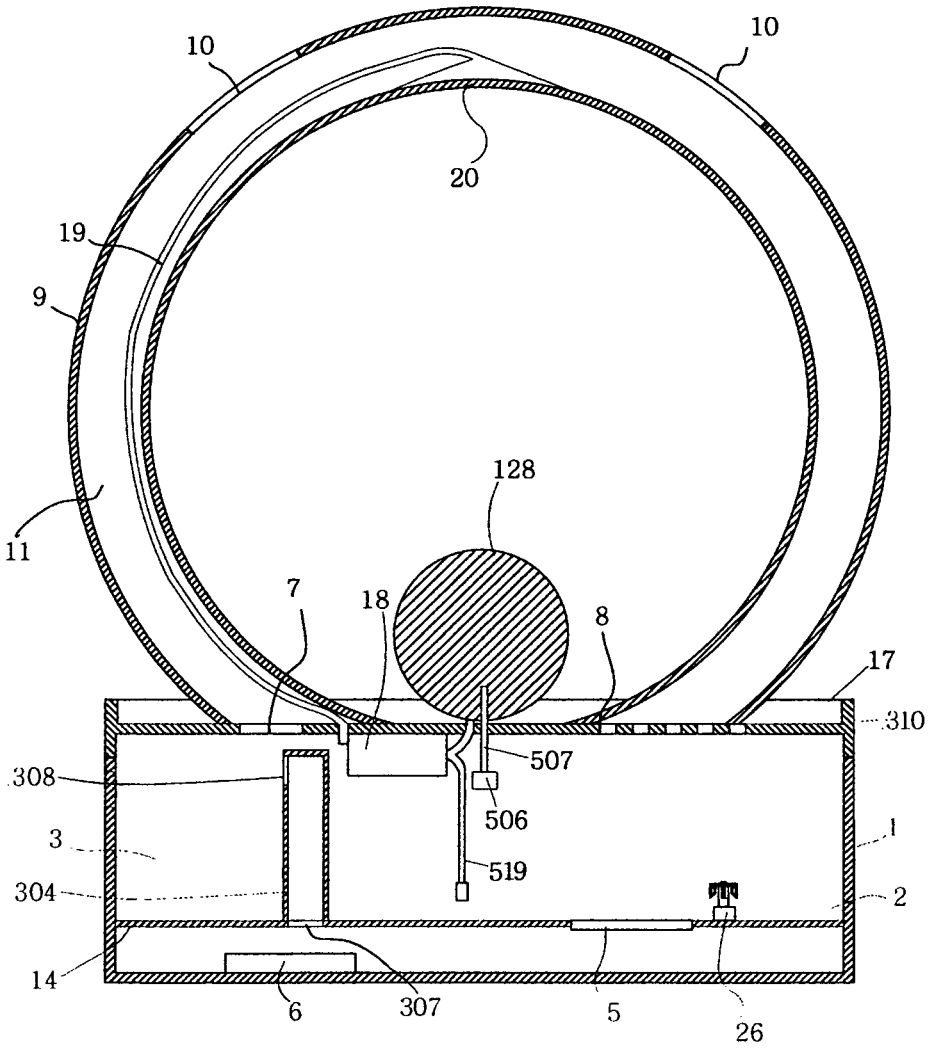
FIG. 5 illustrates an exploded view of the fifth embodiment of the present invention.
Figure 7:
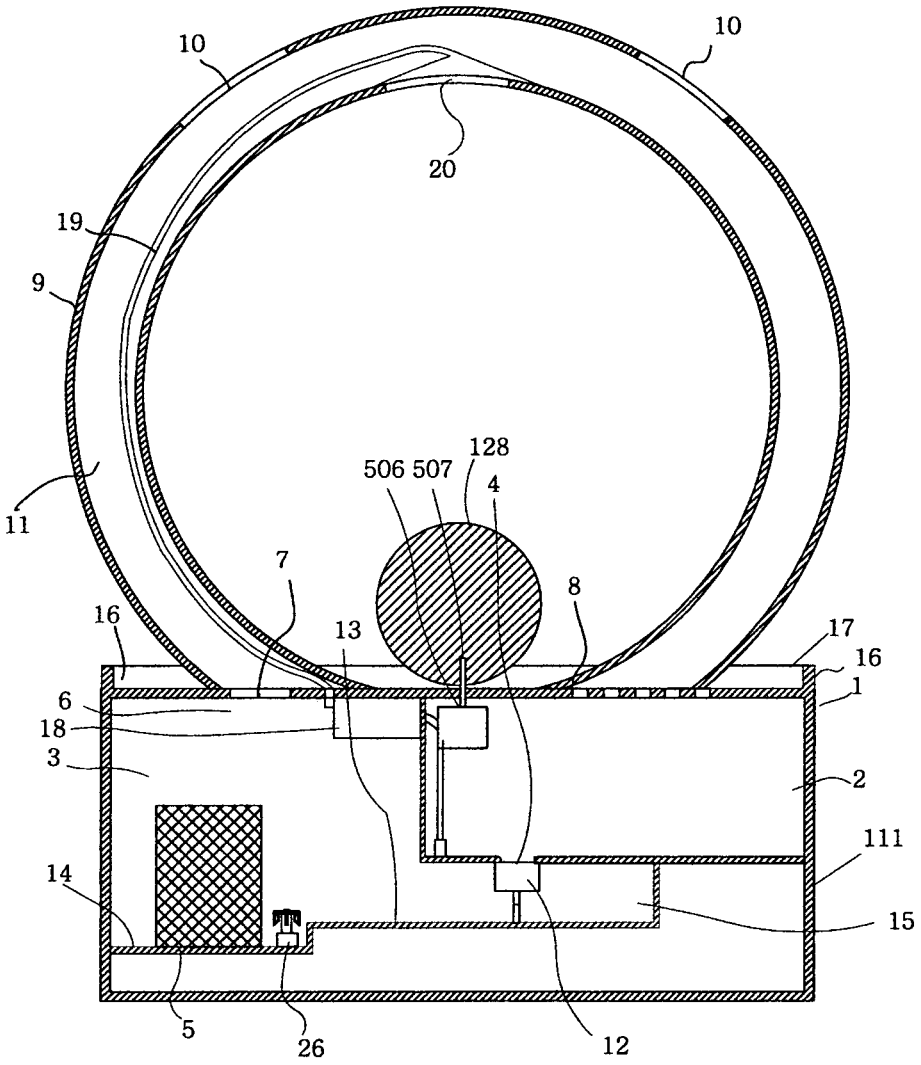
FIG. 7 illustrates an exploded view of the seventh embodiment of the present invention.

FIG. 4, FIG. 5 and FIG. 7 shows the upper surface of the casing 111 is provided with a water barrier 16. The water barrier 16 and the upper surface of the casing 111 form a second water sub-tank 17. The second water sub-tank 17 is connected with the water tank 2 via the water inlet 8. The second water sub-tank 17 will help create more capacity for water tank 2 and also easy to refill water. The second sub-tank 17 can be integrated with the water tank 2 and use the same water inlet 8. The humidifier base 1 is provided with a water pump 18. One end of the water pump 18 is connected with the water tank 2 through the water outlet pipe 519 and the other end is connected with a first water outlet 20 via a first water outlet pipe 19 in the first ornament 9. When water is pumped though the first water outlet pipe 19 and flows out of the first water outlet 20, the water will flow back to the water tank 2 via the water inlet 8. The water pump 18 can suck water though the second water outlet pipe 519 to move the second ornament 128. The water flows out of the first water outlet 20 can also move the second ornament 128. The first water outlet 20 should be higher than the first vapor opening 7 or water inlet 8 by more than half or same height of the casing 111 to make vapor and anion from the waterfall. A power source 506 can also be disposed on the humidifier base 1. The power source 506 drives a shaft 507 to move the second ornament 128 or can be used with an extension mechanism. The cover 310 can be combined with the first ornament 9, which includes the second air guide tube 11, the second vapor opening 10, and the first vapor opening 7, which are all shared in one component. The cover 310 can also be combined with the first ornament 9, which includes the first water outlet pipe 19, and the first water outlet 20 which are all shared in one component. FIG. 1 to FIG. 3 and FIG. 8 to FIG. 33 can be used in this embodiment.

Figure 6:
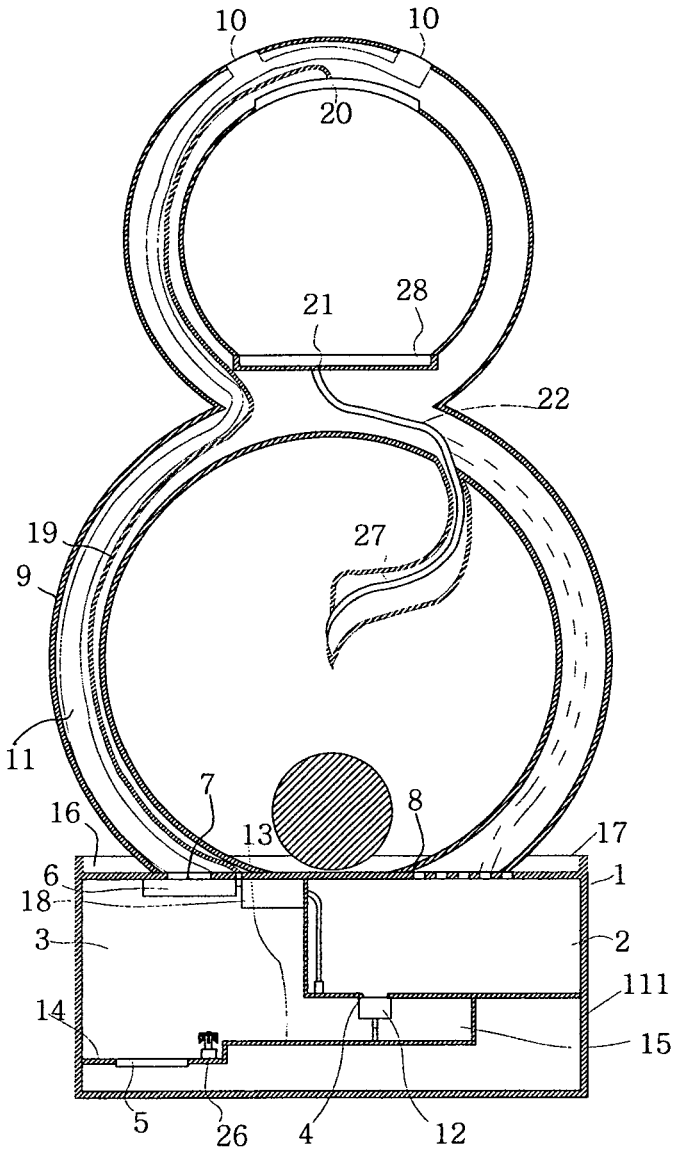
FIG. 6 illustrates an exploded view of the sixth embodiment of the present invention.

FIG. 6 shows first ornament 9 is in a two-layer structure, which is in an 8-shaped structure composed of two annular structures. The first water outlet 20 is at the lower end of the upper annular structure and connected with the water pump 18 via the water outlet pipe 19. A third water sub-tank 28 is disposed beneath the first water outlet 20 where the lower annular structure is located. The third water sub-tank 28 is arranged with a water recycling port 21. The lower annular structure is arranged with a second water outlet 27. The water recycling port 21 is connected with the second water outlet 27 or the water tank 2 via a water recycling pipe 22. FIG. 1 to FIG. 5 and FIG. 8 to FIG. 33 can be used in this embodiment.

Figure 8:
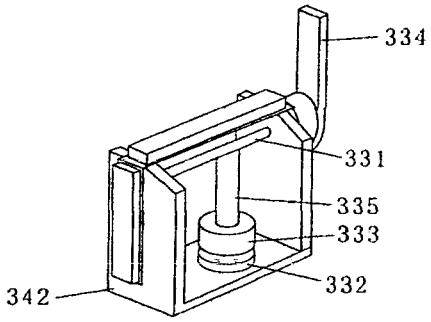
FIGS. 8 and 9 illustrates two moving mechanisms used with a decoration shown in FIG. 10, this structure can also be used with the structures of FIGS. 1-26.
Figure 9:
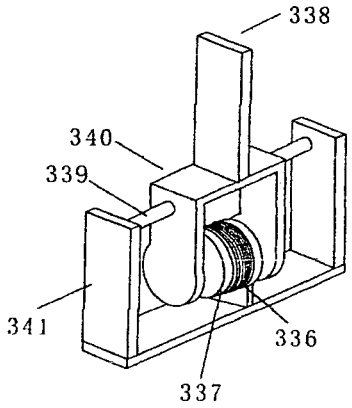
Figure 10:
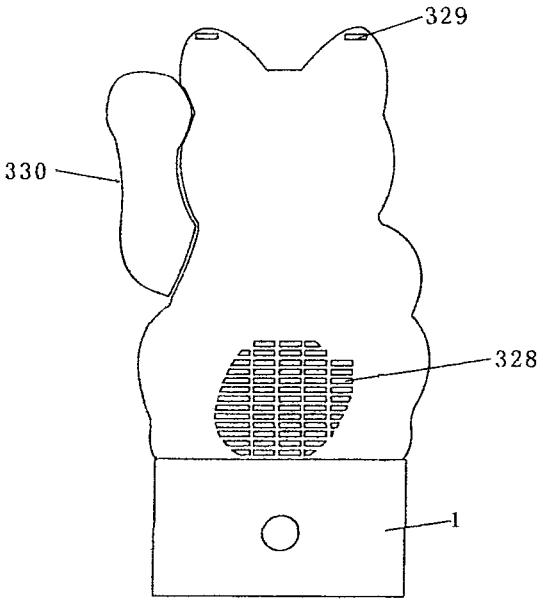
FIG. 10 illustrates another decoration that can be attached to the humidifier, this structure can also be used with the structures of FIGS. 1-26.

FIG. 10 illustrates another decoration that can be attached to the humidifier, and FIGS. 8-9 illustrate two moving mechanisms used with the decoration of FIG. 10. The moving mechanisms shown in FIGS. 8-9 include mainly a coil 332, 336; a magnet 333, 337; a shaft 339, 331; a rocking arm 334, 338; a rocking rode 335, 340; and a fastening frame 341, 342 when the coil 332, 336 is energized, a magnetic force is generated, the rocking rod 335, 340 moves back and forth, thus the rocking arm 334, 338 moves therewith. This makes an arm 330 in FIG. 10 moves back and forth. Numeral 329 in FIG. 10 designates a vapor exit from which a vapor can exit.

The mechanisms shown in FIG. 8-10 can also be used with other embodiments shown in FIGS. 1-7, 31-33 of this invention.

Figure 12:
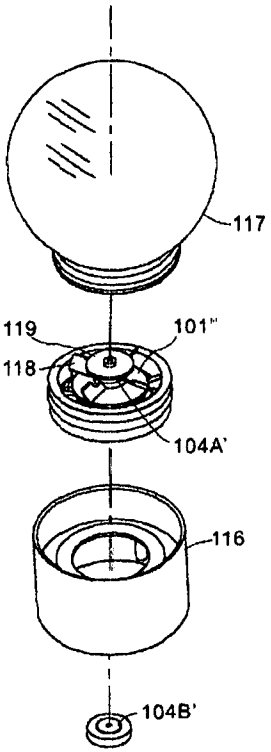
FIGS. 11, 12, . . . , 25, and 26 illustrate a first, second, . . . , fifteenth, and sixteenth subassembly, respectively, than can be used with the embodiments shown in FIGS. 1-7 and 27-33.
Figure 11:
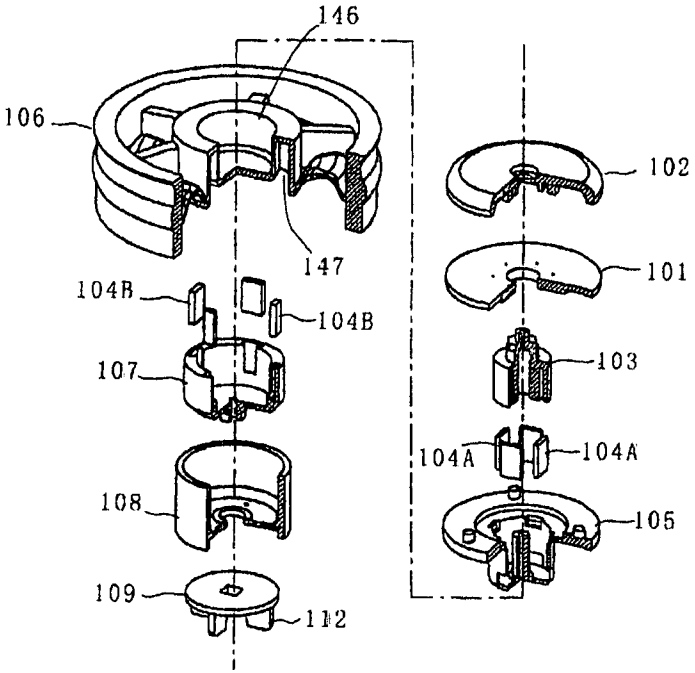

FIGS. 11-26 have basically been shown in a U.S. Pat. No. 6,978,564 (hereinafter designated as '564) invented by the same inventor as that of the present invention. FIGS. 11, 12, . . . , 25, and 26 illustrate a first, second, . . . , fifteenth, and sixteenth subassembly, respectively, that can be used with the embodiments shown in FIGS. 1-7.

FIG. 11 basically is the same as FIG. 1 of '564, but without the musical box and relevant parts shown on the left side thereof. In FIG. 11 the first magnets 104A and the second magnets 104B are for transmitting a movement from a power source from under a stopper member 106 to over the stopper member. A first rotary member 103, a second rotary member 107, a connecting member 105, and a lid 101 can further be provided. The first magnets 104A are installed in the first rotary member 103, the second magnets 104B are installed in the second rotary member 107, the connecting member 105 is fastened to the stopper member 106 and is provided for rotatably accommodating the first rotary member 103, the lid 101 is installed on the connecting member 105 for preventing the first rotary member 103 from falling off. The stopper member 106 can be provided with a first recessed portion 146 for accommodating the first rotary member 103 and the connecting member 105, and a second recessed portion 147 for accommodating the second rotary member 107.

The second rotary member 107 is fastened to the rotary piece 109 so as to rotate therewith. A socket member 108 which can be fastened to the stopper member 106 is for accommodating the second rotary member 107 so as to confine or stabilize the movement of the second rotary member 107. Numeral 102 designates a support on which a figurine or a subassembly can be positioned.

A rotary coupler 112 provided with the rotary piece 109 can be engaged with the shaft 507 of FIG. 7 or other embodiments so that the subassembly shown in FIG. 11 can be in the water receptacle 2. The stopper member 106 can be rubber, metal, plastic or other suitable material.

FIG. 12 is the same as FIG. 4 of '564 but without the musical box and relevant parts. In FIG. 12, the subassembly has a decorative base member 116, a transparent housing 117, at least a first magnet 104A, and at least a second magnet 104B, at least one vane 118 fastened to the first magnet 104A for agitating some particles in the transparent housing 117 so that it looks like some flurries are moved upwardly and falling down. A lid 101 for installing the vane 118 and the magnet 104A; and another lid 119 provided to prevent the vane 118 and the magnet 104A falling off. This subassembly can be connected to the shaft 507 in FIG. 7 and can work with other embodiments and be inside of the water receptacle 2.

Figure 13:
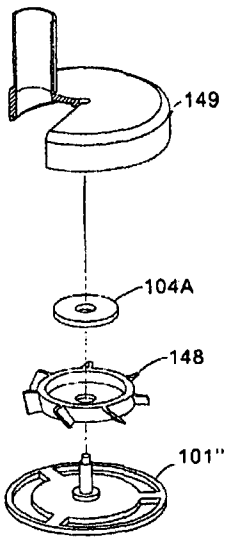

FIG. 13 is the same as FIG. 5 of '564, in which the subassembly includes a rotary member 148 and a magnet 104A positioned in a lid 101; and a lid 149 covering the lid 101, the rotary member 148, and the magnet 104A and has an opening so that the particles agitated by the rotary member 148 can exit. This subassembly can be connected to the shaft 507 in FIG. 7 and can work with other embodiments and be inside of the water receptacle 2.

Please note that the subassemblies shown in FIGS. 8-33 not only be inside of the water receptacle 2, but also be outside of the water receptacle 2.

Figure 14:
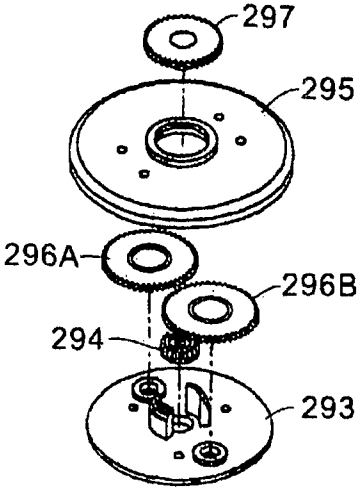

FIG. 14 is the same as FIG. 7 of '564, in which a gear 294 over a lid 293 is connected with the shaft 307 or 316 shown in FIGS. 1-4, two gears 296A and 296B are located engageable with the gear 294. The teeth of the gears 296A and 296B engage with teeth of a rotary cover 295. The teeth of the rotary plate 295 are provided on the inside face of a vertical wall on the peripheral of the rotary cover 295. When the shaft 307 or 316 rotates counterclockwisely, the gear 294 does the same, and the gears 296A and 296B, and the rotary cover 295 rotate clockwisely, and vice versa. A gear 297 can be fastened to the gear 294 or the rotary cover 295 so as to drive other elements not shown in the drawings. We can also eliminate the gear 297 and have a figurine or decoration mounted on the rotary cover 295. The subassembly shown in FIG. 14 can work with other embodiments or subassemblies and can be inside or outside of the water receptacle 2.

Figure 15:
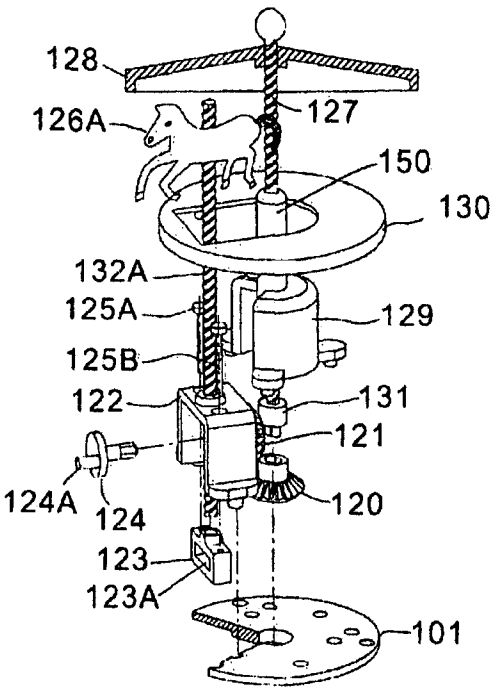

FIG. 15 is the same as FIG. 8 of '564, in which a gear 120 on a lid 101 can be connected with the shaft 507 shown in the FIG. 7. A connecting piece 131 is fastened to the gear 120 and is fixed with a rotary shaft 127 which is installed with a canopy 128. A housing 129 is provided around the shaft 127 indirectly (with a tube 150 in between) to stabilize the rotation of the shaft. The purpose of the tube 150 is to protect the shaft 127. A plate 130 is positioned around the shaft 127 for supporting some decoration (not shown in the drawings). Another gear 121 is engaged with the gear 120 and fastened with a wheel 124 which has an elongate drive stub 124A. A housing 122 is fixed to the lid 101 and is provided around the wheel 124. Another rotary shaft 132A and two guiding rods 125A and 125B are vertically inserted through the housing 122. A link 123 with a longitudinal slot 123A is fastened to the lower end of the rotary shaft 132A. A figurine (horse) 126A is fastened to the upper part of the rotary shaft 132A. The elongate drive stub 124A is movably located in the longitudinal slot 123A. The rotation of the gear 120 causes the rotation of the gear 121 and the wheel 124, which in turn causes the up and down movement of the link 123, the shaft 132A, the guiding rods 125A and 125B, and the horse 126A. The subassembly shown in FIG. 15 can work with other embodiments or subassemblies and can be inside or outside of the water receptacle 2.

Figure 16:
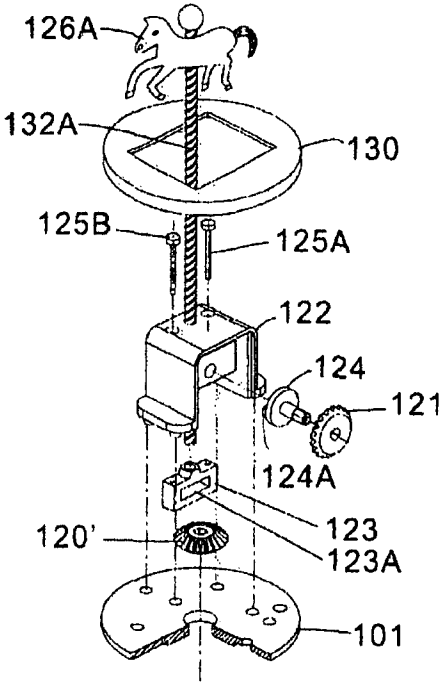

FIG. 16 is the same as FIG. 9 of '564, in which a gear 120' on a lid 101 can be connected with the shaft 507 shown in FIG. 7. Another gear 121 is engaged with the gear 120 and fastened with a wheel 124 which has an elongate drive stub 124A. A housing 122 is fixed to the lid 101 and is provided around the wheel 124. Another rotary shaft 132A and two guiding rods 125A and 125B are vertically inserted through the housing 122. A link 123 with a longitudinal slot 123A is fastened to the lower end of the rotary shaft 132A. A figurine (horse) 126A is fastened to the upper part of the rotary shaft 132A. The elongate drive stub 124A is movably located in the longitudinal slot 123A. The rotation of the gear 120 causes the rotation of the gear 121 and the wheel 124, which in turn causes the up and down movement of the link 123, the shaft 132A, the guiding rods 125A and 125B, and the horse 126A. The subassembly shown in FIG. 16 can work with other embodiments or subassemblies and can be inside or outside of the water receptacle 2.

Figure 17:
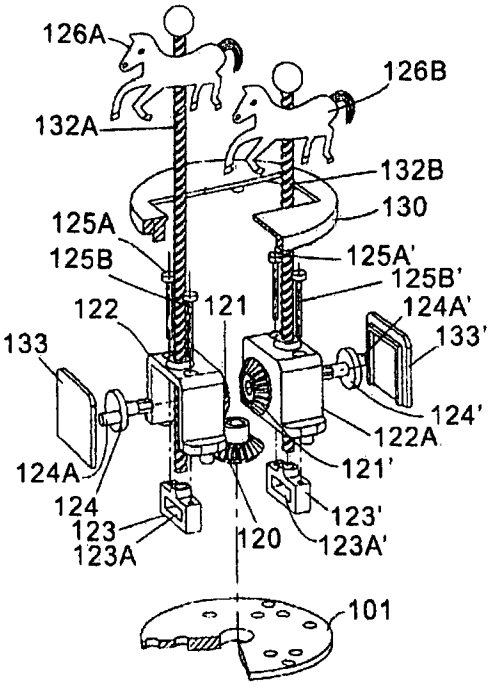

FIG. 17 is the same as FIG. 10 of '564, in which a gear 120 over a lid 101 can be connected with the shaft 507 shown in FIG. 7. Two other gears 121 and 121' are engaged with the gear 120 and fastened with wheels 124 and 124', respectively, which have elongate drive stubs 124A and 124A' respectively. Housings 122 and 122A are fixed to the lid 101 and are provided around the wheels 124 and 124' respectively. Rotary shafts 132A and 132B and two pairs of guiding rods 125A, 125B, and 125A', 125B' are inserted through the housings 122 and 122A respectively. A plate 130 is provided around the shafts 132A and 132B for supporting some decoration (not shown in the drawings). Links 123 and 123' with longitudinal slots 123A and 123A' respectively are fastened to the lower end of the rotary shafts 132A and 132B respectively. The elongate drive stubs 124A and 124A' are movably located in the longitudinal slots 123A and 123A' respectively. The rotation of the gear 120 causes the rotation of the gears 121 and 121' and the wheels 124 and 124', which in turn causes the up and down movement of the links 123 and 123', the shafts 132A and 132B, the guiding rods 125A, 125B, 125A' and 125B', and the horses 126A and 126B. Decoration plates 133 and 133' are employed to cover a side of the housings 122 and 122A respectively. The subassembly shown in FIG. 17 can work with other embodiments or subassemblies and can be inside or outside of the water receptacle 2.

Figure 18:
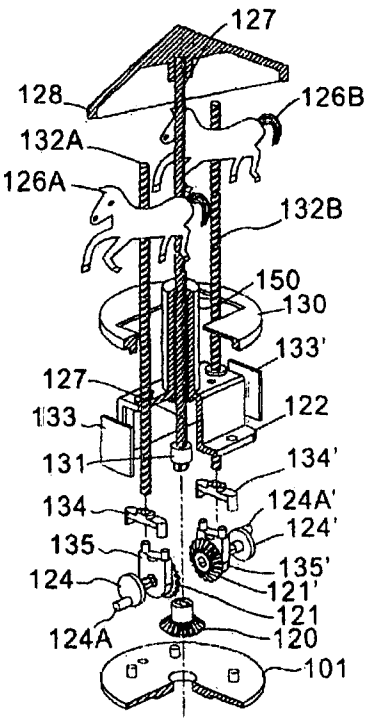

FIG. 18 is the same as FIG. 11 of '564, in which a gear 120 over a lid 101 can be connected with the shaft 507 shown in FIG. 7. FIG. 18 differs from FIG. 17 in that a connecting piece 131 is fixed to the gear 120 and is fastened with a rotary shaft 127 which is protected with a tube 150 and which is fastened with a canopy 128 on its top end. That is to say, all of the elements shown in FIG. 18, except the connecting piece 131, the rotary shaft 127, the tube 150, and the canopy 128, can also be exactly the same as the third embodiment shown in FIG. 17, instead of those shown in FIG. 18. In FIG. 18, one housing 122 is employed to replace the two housings 122 and 122A shown in FIG. 17. Links 134 are fastened to the lower ends of the shafts 132A and 132B respectively for being moved by the elongate drive stubs 124A and 124A, respectively. Two connecting pieces 135 are employed for installing the wheels 124, 124' and the gears 121, respectively. The subassembly shown in FIG. 18 can work with other embodiments or subassemblies and can be inside or outside of the water receptacle 2.

Figure 19:
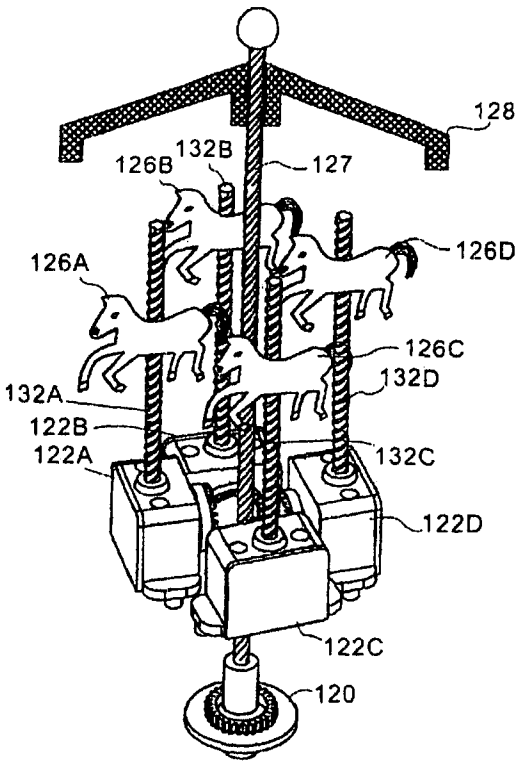

FIG. 19 is the same as FIG. 12 of '564, in which a gear 120 can be connected with the shaft 507 shown in FIG. 7. The subassembly shown in FIG. 19 is very similar to the fourth embodiment (FIG. 18) of the subassembly. In FIG. 19, there are four rotary shafts 132A, 132B, 132C, 132D for installing four horses 126A, 126B, 126C, 126D respectively. Four housings 122A, 122B, 122C, 122D are provided around the four rotary shafts 132A, 132B, 132C, 132D respectively. A rotary shaft 127 is installed on a bearing 120 and is fastened with a canopy 128. The subassembly shown in FIG. 19 can work with other embodiments or subassemblies and can be inside or outside of the water receptacle 2.

Figure 20:
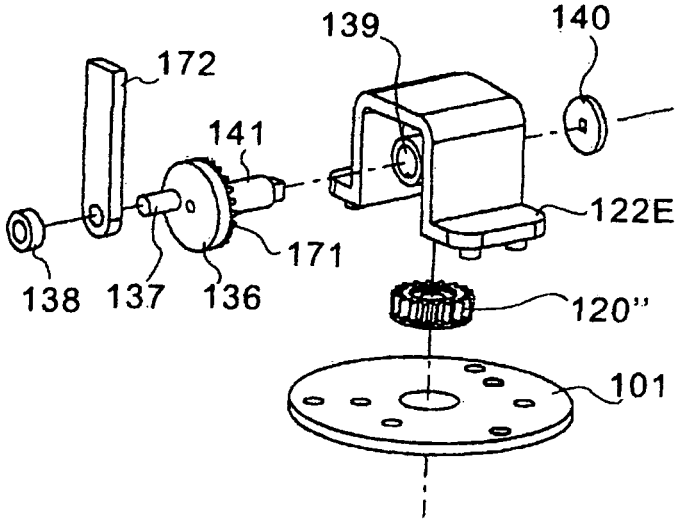
Figure 21:
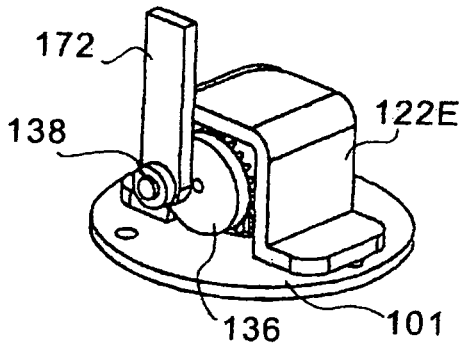

FIGS. 20 and 21 are the same as FIGS. 13 and 14 of '564, in which a gear 120" over a lid 101 can be connected with the shaft 507 shown in FIG. 7. A housing 122E can be fastened to the lid 101. A support tube 139 is provided on the housing 122E, for rotatably supporting a shaft 141. A wheel 136 and a gear 171 (which is engageable with the gear 120") are fixed on the shaft 144. An elongate drive stub 137 is provided on the wheel 136. The stub 137 can be inserted through a hole provided on a rod 172 on which a figurine or a decoration can be fixed. A ring 138 and a fastening piece 140 are fixed to the stub 137 and the end of the shaft 141, respectively. When the gear 120" rotates, the gear 171 and the wheel 136 rotate, thus in turn the stub 137 causes the rod 172 to do reciprocating movement. The subassembly shown in FIGS. 20 and 21 can work with other embodiments or subassemblies and can be inside or outside of the water receptacle 2.

Figure 22:
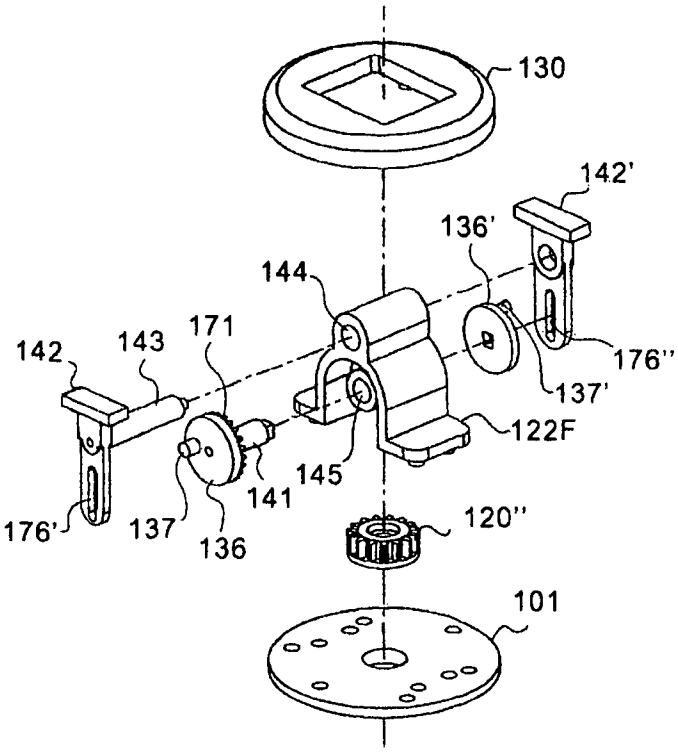

FIG. 22 is the same as FIG. 15 of '564, in which a gear 120" over a lid 101 can be connected with the shaft 507 shown in FIG. 7. A housing 122F can be fastened to the lid 101. Two support tubes 144 and 145 can be formed on the housing 122F, for rotatably supporting shafts 141 and 143. A wheel 136 and a gear 171 (which is engageable with the gear 120") are fixed on one side of the shaft housing 122F 141. Another wheel 136' is fixed in the other side of the shaft 141. The wheels 136 are 136' are provided with elongate drive stubs 137 and 137', respectively. Connecting pieces 142 and 142' are fixed to the two ends of the shaft 141, respectively. Longitudinal slot 176' and 176", in which the elongate drive stubs 137 and 137' can slide respectively, are formed on the connecting pieces 142 and 142', respectively. Figurines or decorations can be positioned on the connecting pieces 142 and 142'. A plate 130 is provided for supporting figurines or decorations. When the gear 120" rotates, the gear 171, the shaft 141, and the wheels 136 and 136' rotates therewith, thus in turn causes the connecting pieces 142 and 142' to do reciprocating movement. The subassembly shown in FIG. 22 can work with other embodiments or subassemblies and can be inside or outside of the water receptacle 2.

Figure 23:
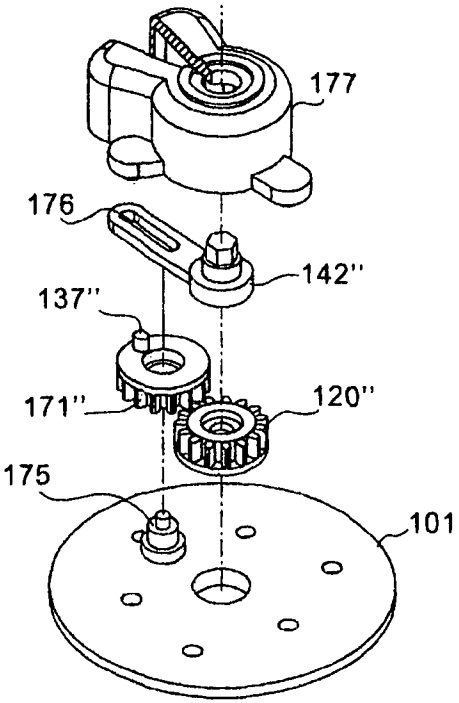

FIG. 23 is the same as FIG. 16 of '564, in which a gear 128" over a lid 101 can be connected with the shaft 507 shown in FIG. 7. A rod 175 is fixed on the lid 101. A gear 171' and a wheel 136" having a through hole in the central portion thereof respectively are rotatably installed on the rod 175. The gear 171' is engageable with the gear 120". An elongate drive stub 137" is formed on the wheel 136". A connecting piece 142", on which a figurine or decoration can be fixed, is rotatably installed on top of the gear 120". The connecting piece 142" is formed with a longitudinal slot 176 in which the elongate drive stub 137" can slide. A lid 177 is positioned over connecting piece 142" for confining the movement of the connecting piece 142". When the gear 120" rotates, the gear 171', and the wheel 136" rotate, thus in turn causes a reciprocate movement of the connecting piece 142". The subassembly shown in FIG. 23 can work with other embodiments or subassemblies and can be inside or outside of the water receptacle 2.

Figure 24:
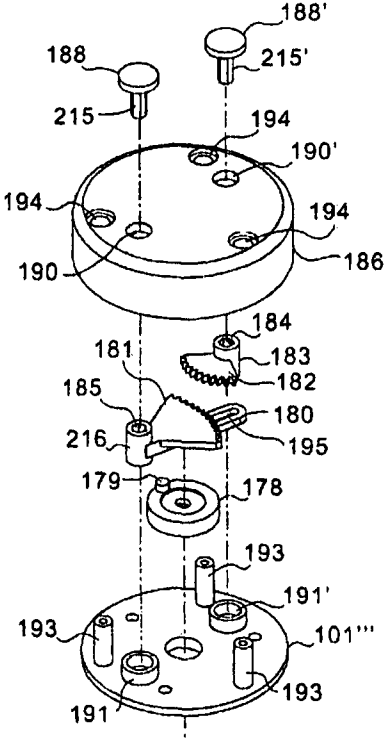

FIG. 24 is the same as FIG. 17 of '564, in which a wheel 178 having an elongate drive stub 179 can be connected with the shaft 507 shown in FIG. 7. A plurality of tubes 193, 191, 180 having a longitudinal slot 195 is fixed with a tube 216 having a hole 185 and a gear plate 181. A tube 183 having a hole 184 is fixed with a gear plate 182. The elongate drive stub 179 is located in the longitudinal slot 195 and slideable therein when the wheel 178 rotates. A cover plate 186 is positioned on the lid 101'" and is provided with holes 194, 190 and 190'. The upper ends of the tubes 193 are fastened at the holes 194 of the cover plate 186. Two supports 188 and 188' for supporting figurines or decorations thereon are fixed with rods 215 and 215' respectively. The rods 215 and 215' are inserted through the holes 190 and 190' respectively, and fastened in the holes 185 and 184 of the tubes 216 and 183 respectively. The tubes 216 and 183 are rotatably installed in the tubes 191 and 191' respectively. When the wheel 178 rotates, the elongate drive stub 179 drives the moving piece 180, the tube 216 and the gear plate 181 which engages with the gear plate 182 to reciprocate. Thus this causes the gear plate 182, the tube 183, the rods 215 and 215', and the supports 188 and 188' to reciprocate. The subassembly shown in FIG. 24 can work with other embodiments or subassemblies and can be inside or outside of the water receptacle 2.

Figure 25:
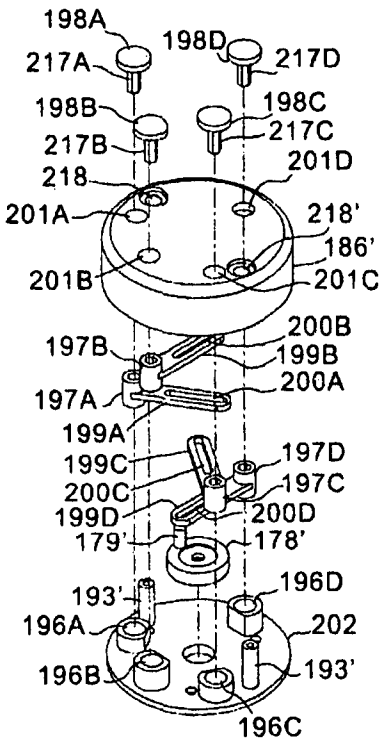

FIG. 25 is the same as FIG. 18 of '564, in which a wheel 178' having an elongate drive stub 179' can be connected with the shaft 507 shown in FIG. 7. A plurality of tubes 193', 196A, 196B, 196C, and 196D are provided on the lid. Rotary tubes 197A, 197B, 197C, and 197D are rotatably installed in the tubes 196A, 196B, 196C, and 196D respectively, and fastened with connecting pieces 199A, 199B, 199C, and 199D respectively, which are provided with longitudinal slots 200A, 200B, 200C, and 200D respectively. The elongate drive stub 179' can be inserted into the longitudinal slots 200A, 200B, 200C, and 200D and slide therein when the wheel 178' rotates. A cover plate 186' is positioned on the lid 202 and is provided with holes 218, 218', 201A, 201B, 201C, and 201D. Supports 198A, 198B, 198C, and 198D for supporting figurines or decorations thereon are fastened with rods 217A, 217B, 217C, and 217D respectively, which insert through the holes 201A, 201B, 201C, and 201D on the cover plate 186' respectively, and installed in the rotary tubes 197A, 197B, 197C, and 197D respectively. When the wheel 178' rotates, the elongate drive stub 179' drives the connecting pieces 199A, 199B, 199C, and 199D to reciprocate, and the rotary tubes 197A, 197B, 197C, and 197D to rotate, respectively. Thus the rods 217A, 217B, 217C, and 217D, and supports 198A, 198B, 198C, and 198D rotate respectively. The cover plate 186' is fastened to the upper ends of the tubes 193' at the holes 218 and 218'. The movement of the connecting pieces 199A, 199B, 199C, and 199D does not interfere with each other because they are on different heights (levels). The subassembly shown in FIG. 25 can work with other embodiments or subassemblies and can be inside or outside of the water receptacle 2.

Figure 26:
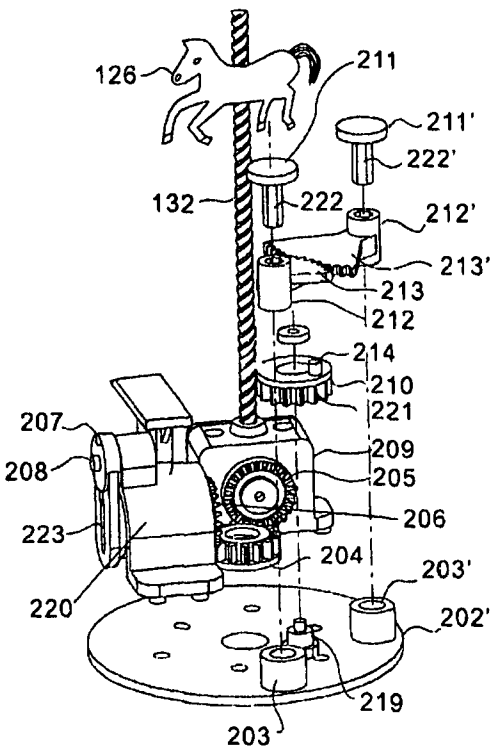

FIG. 26 is the same as FIG. 19 of '564, in which a gear 204 can be connected with the shaft 507 shown in FIG. 7. A rod 219 and tubes 203 and 203' are provided on the lid 202'. A gear 221 and a wheel 210 having an elongate drive stub 214 are rotatably provided on the rod 219. A gear 204 engageable with the gear 221 can be installed on a rotary rod 219 and tubes 103 (FIG. 1) and rotate therewith. A rotary tube 212 is fixed with a gear plate 213 which is engageable with a gear plate 213' fixed with a rotary tube 212'. A moving piece and a longitudinal slot (in which the elongate drive stub 214 slides) similar to the moving piece 180 and the longitudinal slot 195 shown in FIG. 17 are provided under the gear plate 213 and fixed to the rotary tube 212. Supports 211 and 211' for supporting figurines or decorations having rods 222 and 222' are fastened to the rotary tubes 212 and 212' respectively, with the rods 222 and 222' inserted into the tubes 212 and 212' respectively. When the wheel 210 rotates, the stub 214 drives the tubes 212 and 212', the gear plates 213, and 213', and the supports 211, and 211' to move. A housing 209 is fastened to the lid 202', with a rotary shaft 132 provided therethrough. A gear 205 (engageable with the gear 204) and a wheel with an elongate drive stub (not shown in the drawing) (similar to the gear 121 and wheel 124 with an elongate drive stub 124A in FIG. 8) can be installed on the housing 209. A link with a longitudinal slot (not shown in the drawing) (similar to the link 123 with the longitudinal slot 123A in FIG. 8) can be fixed to the lower end of the shaft 125. When the wheel 205 rotates, the shaft 132 and the horse 126 move upwardly and downwardly. Another housing 220 is fastened to the lid 202' with a gear 206 rotatably installed on it. The gear 206 is engageable with the gear 204. The inside structure of the housing 220 is similar to that shown in FIGS. 13 and 14 (i.e., a wheel with an elongate drive stub not shown in the drawing is fastened to the gear 206). A connecting piece 207 having a longitudinal slot 223 is rotatably installed on a shaft 208. The elongate drive stub in the housing 220 is located in the longitudinal slot 223 and can slide thereon. A figurine or a decoration can be fastened to the connecting piece 207. When the gear 206 rotates, the wheel rotates, the stub drives the connecting piece 207 to reciprocate. The subassembly shown in FIG. 26 can work with other embodiments or subassemblies and can be inside or outside of the water receptacle 2.

The inventor of the present invention also has the following twelve U.S. patents granted: U.S. Pat. Nos. 5,078,386; 5,088,373; 5,070,753; 5,286,535; 4,890,828; 5,203,743; 4,987,787; 6,978,564, 4,939,944; 5,448,007; 5,081,899; and 5,163,878. These patents can be used with the structures of FIGS. 1-7, 31-33 of the present invention.

Figure 27:
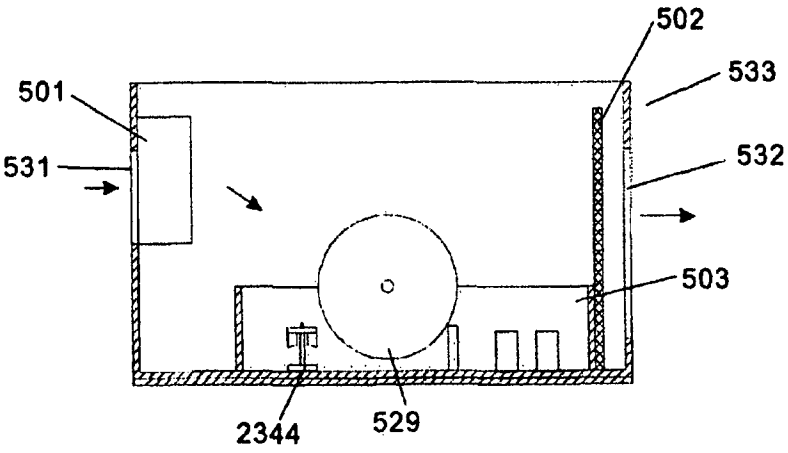
FIG. 27 is a longitudinal sectional view of a support seat of the embodiments of the present invention, having a single water wheel, in which the structures of FIGS. 1-26 can be used with this structure.

FIG. 27 shows seat 533 of the embodiments in the present invention. A water wheel 529 is provided in the water sub-receptacle 503. When the fan 501 is turned on, wind blows from the wind inlet 531, toward the water and water wheel 529 in the water sub-receptacle 503 so that the water wheel 529 rotates and the water in the water sub-receptacle 503 moves, so as to clean the air. The number of the water wheel 529 can be one or more than one. The structures shown in FIGS. 1-7 and 31-33 also can be used with this structure.

Figure 28:
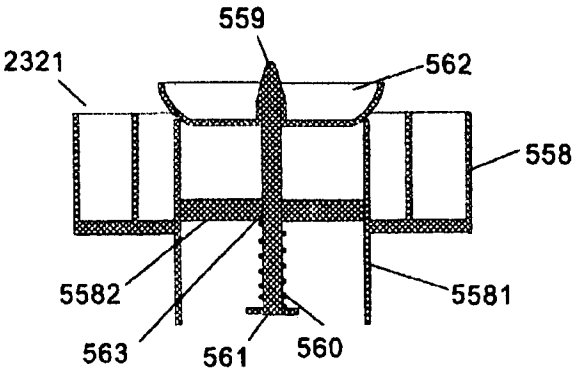
FIG. 28 is a longitudinal sectional view of a water exit valve, this structure can also be used with the structures of FIGS. 1-27.

FIG. 28 shows a sectional view of the water exit valve 12 in FIGS. 2-7, A hollow rod-shaped structure 5581 is provided in an outer housing 558 which has a larger diameter than that of the hollow rod-shaped structure 5581. The hollow rod-shaped structure 5581 is provided with a horizontal rod 5582 which in turn is provided with a communication hole 563 in which an abutment rod 581 is provided. A conical shaped retaining head 559 is provided on the top of the abutment rod 561 which is surrounded with a spring 560 on the lower portion thereof. One end of the spring 560 abuts against the hollow rod-shaped structure 5581, the other end of the spring 560 abuts against the bottom of the abutment rod 561. A soft stopper (which can be made of rubber, plastic, or other suitable material) 562 is provided under and around the conical shaped retaining head 559. The soft stopper 562 is of a shape similar to a bowl, with a lower edge abuts against the hollow rod-shaped structure 5581. When in use, the outer housing 558 is fit to the water receptacle at the water exit 4.

Figure 30:
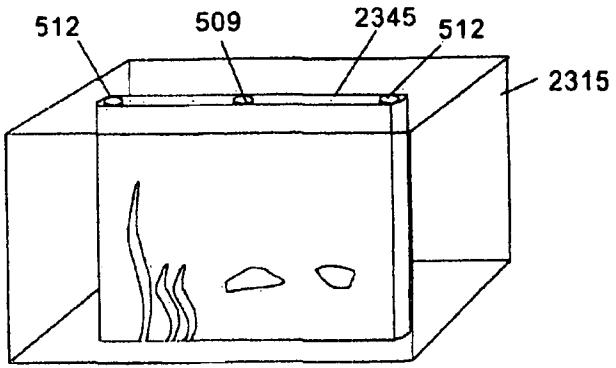
FIG. 30 is another extended mechanism which can be used with the structures of FIGS. 1-29, and 31-33.
Figure 29:
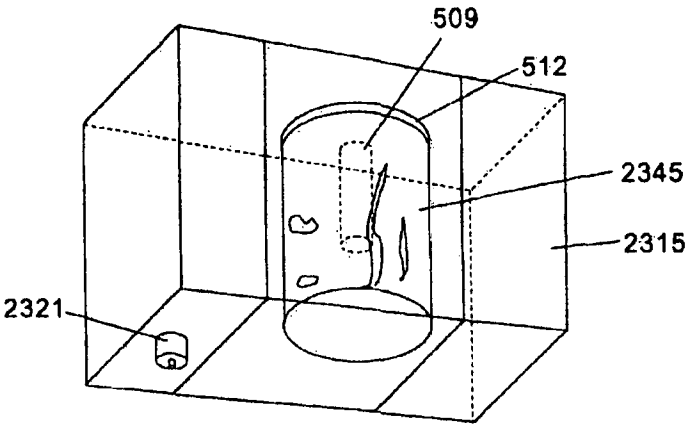
FIG. 29 is an extended mechanism which can be used with the structures of FIGS. 1-28, and 30-33.

FIGS. 29-30 show two extended mechanisms of the present invention. These two mechanisms also can be used with the structures shown in FIGS. 1-7, and 31-33.

As shown in FIG. 29, a light 509 is provided in the water receptacle 2315. A decoration 2345 is provided outside of the light 509. A transmission mechanism 512 (which can be connected to the shaft 507 of FIG. 7) is provided on the decoration 2345 so as to move the latter.

As shown in FIG. 30, two transmission mechanisms 512 (which can be of the shape of two rollers and one of them can be connected to the shaft 507 of FIG. 7) is provided in the decoration 2345. A light 509 is provided in the middle of the decoration 2345. When in use, as shown in FIGS. 29-30, the light 509 illuminates the pictures on the decoration 2345 so as to produce a visual effect which is an extra effect of the decorative humidifier of the present invention which can purify the air, humidify the air, and deliver the wind.

Figure 31:
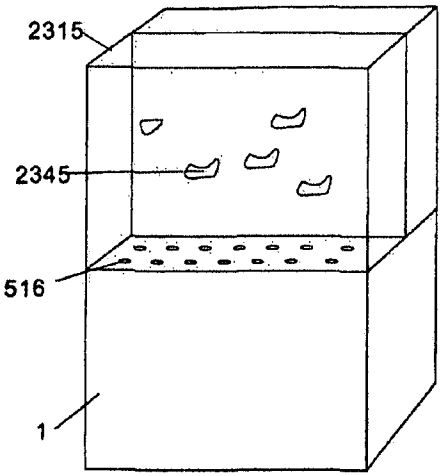
FIG. 31 is another extended mechanism which can be used with the structures of FIGS. 1-30, and 32-33.

As shown in FIG. 31, a water receptacle 2315 is provided on the base land is provided with a plurality of second holes 516 (at its bottom) which in turn is connected with a pump 18 shown in FIGS. 4-7. A plurality of decorations 2345 are provided and are suspended (floated) in the water receptacle 2315. The pump 18 (in FIGS. 5-7) can pump air or can be a making water bubbles device to pumps water bubbles, through the second holes 516 in the bottom of the water receptacle 2315, the water bubbles in the water receptacle 2315 pushes the decorations 2345 (e.g. a plurality of fishes) upwardly, which in turn sink downwardly (because of their own weights) toward the bottom of the water receptacle 2315. Thus the decorations 2345 can repeatedly move upwardly and downwardly enhance the visual effects, which is an extra effect of the decorative humidifier of the present invention which can purify the air, humidify the air, and deliver the wind. FIGS. 29-30 can also serve as a background picture in this mechanism. The structures in FIGS. 1-30 can be used with this mechanism.

Figure 32:
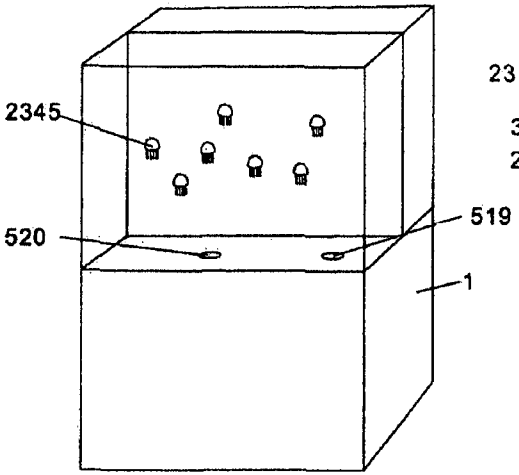
FIG. 32 is yet another extended mechanism which can be used with the structures of FIGS. 1-31.

As shown in FIG. 32, a water receptacle 2315 is provided on the base 1 and is provided with a third water exit 520 and a first water inlet 519 at its bottom a vane (fan) 118 shown in FIG. 12 (or fan 148 in FIG. 13) or water pump 18 connects with the first water inlet 519. A plurality of decorations (in the shapes of jelly fishes) are provided and are suspended (floated) in the water receptacle 2315. When the van 118 or fan 148 move, or the water pump 540 pumps water into the water receptacle 2315 through the first water inlet 519, the water enters the support seat 533 through the third water exit 520. Thus the water can circulate between the water receptacle 2315 and the support seat 533, so that the decorations 2345 can move upwardly and downwardly repeatedly. A light not shown in the drawings can also be provided to enhance the visual effects, which is an extra effect of the decorative humidifier of the present invention which can purify the air, humidify the air, and deliver wind. FIGS. 29-30 can also serve as a background picture in this mechanism. The structure in FIGS. 1-30 can also be used with this mechanism.

Figure 33:
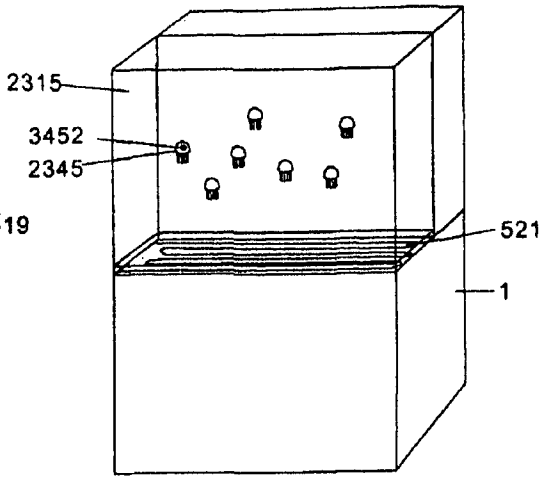
FIG. 33 is yet another extended mechanism which can be used with the structures of FIG. 1-32.

As shown in FIG. 33, a first magnetic device 521 is provided on the bottom of the water receptacle 2315 which in turn is provided on the base 1. A plurality of decorations 2345 are provided and are suspended (floated) in the water receptacle 2315. The decorations are provided with a second magnetic device 3452 respectively. When the first magnet device 521 is energized, the magnetic force thereof exerts a pushing force against the second magnetic devices 3452 (because of same polarity therewith) in the decorations 2345, so that the decorations 2345 are prevented from sinking to the bottom of the water receptacle 2315, and can move around in the water receptacle 2315. Each of the decorations are of different weights and therefore will move around at different heights in the water receptacle 2315. FIGS. 29-30 can serve also as a background picture in this mechanism. The structures 1-30 can also be used with this mechanism.

The foregoing description is provided for illustrative purposes only and should not be construed as any way limiting this invention, the scope of which is defined solely by the appended claims.

The invention claimed is:

1. An air humidifier comprising a water receptacle, a fan, a device for transforming water into vapor, an air humidifier base cover, wherein the outside of an air humidifier base cover is connected with at least one ornament, wherein the air humidifier base cover to combine with the ornament, and wherein the ornament includes an air guide tube, a first vapor opening and a second vapor opening, wherein the second vapor guide is connecting with the first vapor opening.

2. The air humidifier of claim 1, further comprising a device to making air bubbles.

3. The air humidifier of claim 1, further comprising at least one magnet or magnetic device.

4. The air humidifier of claim 1, further comprising a shaft.

5. The air humidifier of claim 1, further comprising a pump.

6. An air humidifier comprising a base, wherein the outside of base is connected with at least one ornament, wherein the base includes a water receptacle, a fan, and a device for transforming water into vapor, wherein the ornament includes a second air guide tube, first vapor opening and a second vapor opening, wherein the second vapor opening in the ornament is higher than the first vapor opening by at least half of the height of the base.

7. The air humidifier of claim 6, further comprising a device to making air bubbles.

8. The air humidifier of claim 6, further comprising at least one magnet or magnetic device.

9. The air humidifier of claim 6, further comprising a shaft.

10. The air humidifier of claim 6, further comprising a pump.

11. An air humidifier comprises including a base, the base including a water receptacle, a fan, a pump, the base is provided with a water barrier and the upper surface of the casing to form a second water sub-tank; the second water sub-tank is connected with a water tank via a water inlet.

12. The air humidifier of claim 11, further comprising at least one magnet or magnetic drive.

13. The air humidifier of claim 11, further comprising a device to making water bubbles.

14. The air humidifier of claim 11, further comprising a shaft.

* * * * *